US007980541B2

(12) United States Patent
Schnell et al.

(10) Patent No.: US 7,980,541 B2
(45) Date of Patent: Jul. 19, 2011

(54) SPLITTING DEVICE

(75) Inventors: Helmut Schnell, Augsburg (DE); Urban Spatz, Neusäβ (DE)

(73) Assignee: manroland AG, Offenbach am Main (DE)

( * ) Notice: Subject to any disclaimer, the term of this patent is extended or adjusted under 35 U.S.C. 154(b) by 128 days.

(21) Appl. No.: 12/472,907

(22) Filed: May 27, 2009

(65) Prior Publication Data

US 2009/0295058 A1 Dec. 3, 2009

(30) Foreign Application Priority Data

May 27, 2008 (DE) ..... 10 2008 025 415
Jul. 11, 2008 (DE) ..... 10 2008 032 622

(51) Int. Cl.
*B65H 37/04* (2006.01)

(52) U.S. Cl. ..... 270/5.02; 270/6; 270/10; 270/13; 271/303

(58) Field of Classification Search ..... 271/303; 270/6, 5.02, 10, 13
See application file for complete search history.

(56) References Cited

U.S. PATENT DOCUMENTS 4,277,061 A * 7/1981 Nagel et al. ..... 271/302
4,373,713 A 2/1983 Loebach
4,538,800 A * 9/1985 Richter ..... 271/120
5,029,842 A * 7/1991 Belanger et al. ..... 271/188
6,254,093 B1 * 7/2001 d'Agrella et al. ..... 271/279
6,572,098 B2 * 6/2003 Schaefer et al. ..... 271/186
6,644,655 B2 * 11/2003 Wurschum ..... 271/225
2009/0305860 A1 * 12/2009 Schnell et al. ..... 493/358

FOREIGN PATENT DOCUMENTS

DE 2 200 260 8/1972
DE 199 55 815 7/2000
EP 0 054 963 6/1982

* cited by examiner

*Primary Examiner* — Patrick Mackey
(74) *Attorney, Agent, or Firm* — Cohen Pontani Lieberman & Pavane LLP

(57) ABSTRACT

A device for distributing successive products of a product flow, particularly the successive folding products produced by a cross cutting device by dividing a material web, to two branch flows, with a wedge arrangement which is arranged in a stationary manner in the transporting plane of the product flow and which engages between two cam rollers which flank it and which are arranged symmetrically with respect to the center working plane. The device is characterized in that the wedge arrangement engages between two guide plates which flank it and which, together with the wedge arrangement, define a path fork. The guide plates have slots through which they are alternately penetrated by cams of the respective adjacent cam roller which are associated with the slots, so that the penetrating cams and the guide plate which is not penetrated form a feed for a belt guide associated with a branch flow.

8 Claims, 5 Drawing Sheets

SPLITTING DEVICE

BACKGROUND OF THE INVENTION

1. Field of the Invention

The invention is directed to a device for distributing successive products of a product flow, particularly the folding products formed by a cross cutter by dividing a material web, to two branch flows.

2. Description of the Related Art

In known arrangements of the type mentioned above, splitting devices include a swivelable tongue, which alternately feeds the successive products to one branch flow or the other. The tongue is a stationary structural component part in relation to the moving products. Therefore, owing to the relative movements between the products and the tongue, marks may be produced on the products and, when processing printed products, ink smears and the like may occur. Therefore, the known arrangements have not proved sufficiently production-friendly.

EP 0054963 A1 shows a splitting arrangement with wedges that are arranged in a stationary manner in the transporting plane of the product flow and which are arranged adjacent to one another transverse to the transporting direction. Together with two belts which are guided through the splitting arrangement, the wedges form a path fork which is symmetric to the transporting plane and opens downward. Adjoining the wedges below the path fork on the inner side are transporting belts which define the two paths leading out of the fork. Two cam rollers which flank the wedge and which have cams and recesses in an area between the wedges are associated with the two side faces of the wedge. Each cam on one cam roller has associated with it an area on the other cam roller serving as a holding surface at which no cams are provided and over which the transporting belt is guided. Accordingly, the transporting belts run laterally next to the cams through the splitting device. Therefore, the products passing through the splitting device cannot be supported or deflected by the cams in these areas of the respective belts.

SUMMARY OF THE INVENTION

It is an object of the present invention to improve a device of the type mentioned above in a simple and economical manner in such a way that the products are handled with care and a high quality of the product is ensured.

In a device of the type mentioned above having a wedge arrangement which is arranged in a stationary manner in the transporting plane of the product flow and which engages between two cam rollers which flank it and which are arranged symmetrically with respect to the center working plane, the above-stated object is met according to the invention in that the wedge arrangement is arranged between two guide plates which flank the wedge arrangement and which, together with the wedge arrangement, define a path fork, wherein the guide plates have slots through which they are alternately penetrated by cams of the respective adjacent cam roller which are associated with the slots, so that the penetrating cams and the guide plate which is not penetrated form a feed for a belt guide associated with a branch flow.

The products are preferably guided between the guide plates and the cams reliably and along their entire width. The products can also be fed to and carried away from the splitting device at high speeds in a reliable manner and without damage. To this end, it is necessary for the products to be guided at their lateral edges in the belt guide leading to and away from the splitting device, and this guidance can be ensured even when the product widths correspond to the distance between the outer belts. Altogether, this prevents a paper backup which would occur in a known device when the lateral product edges which are not deflected collide with the tip of the stationary wedge arrangement.

In an advantageous manner, there is no relative movement between the cams of the rotating cam rollers and the products so that marks and smeared ink, etc. are prevented.

In an advantageous manner, the cam rollers have a plurality of cams arranged in a closely spaced manner next to one another along their length, and the guide plates have a plurality of slots associated with the cams, e.g., 10 to 20, or more, cams and slots. Further, the cam rollers can advantageously have continuous shafts on which are clamped a plurality of cam carriers provided with a quantity of cams. In this connection, it is particularly advantageous when the wedge arrangement comprises a quantity of wedges which are continuous at least along the width of the cam rollers which is provided with cams. The plurality of closely spaced, thin cams reliably deflect the product over the wedge or wedge arrangement into the respective continuing belt guide across the entire width of the product. The wedge arrangement and the guide plates through which the cam disks penetrate define the free space of the products and prevent the products from being overturned and damaged.

The wedge arrangement comprises one or more wedges. The wedge or wedges can lie with their tips behind the area swept over by the two cam rollers. In this case, the close spacing of the splitting cams prevents either the front edge of the product or the end of the product from coming into contact with the stationary wedge tip. The wedge can also be slotted toward the cam rollers like the guide plates so that the wedge or wedges can also be penetrated by the cams of the cam rollers, and their side walls offer additional support of the products toward the inner side.

When the cams of the two cam rollers each extend over a circumferential segment, preferably of substantially identical dimensions, which sweeps over an entire product length given a suitable circumferential speed, the front edge of the product, after exiting the belt guide, is deflected and guided by the cams in the corresponding direction of the continuing belt guide. When the front edge of the product reenters the belt guide downstream of the splitting device, the end of the product is still guided in the belt guide in front of the splitting device. This ensures a continuous guiding of the product.

Accordingly, the belt guide need not be guided through the device, but runs on the outer side around the device and subsequently resumes guiding the product so that a good guiding is ensured on the path formed by the guide plates, cams and—optionally—the side walls of the wedge without the above-mentioned risk of a paper backup.

Advantageous constructions and advisable further developments of the principal steps are indicated in the subclaims and are described in more detail by examples in the following description with reference to the drawings.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings which will be described in the following.

DETAILED DESCRIPTION OF THE PRESENTLY PREFERRED EMBODIMENTS

Figure 1:
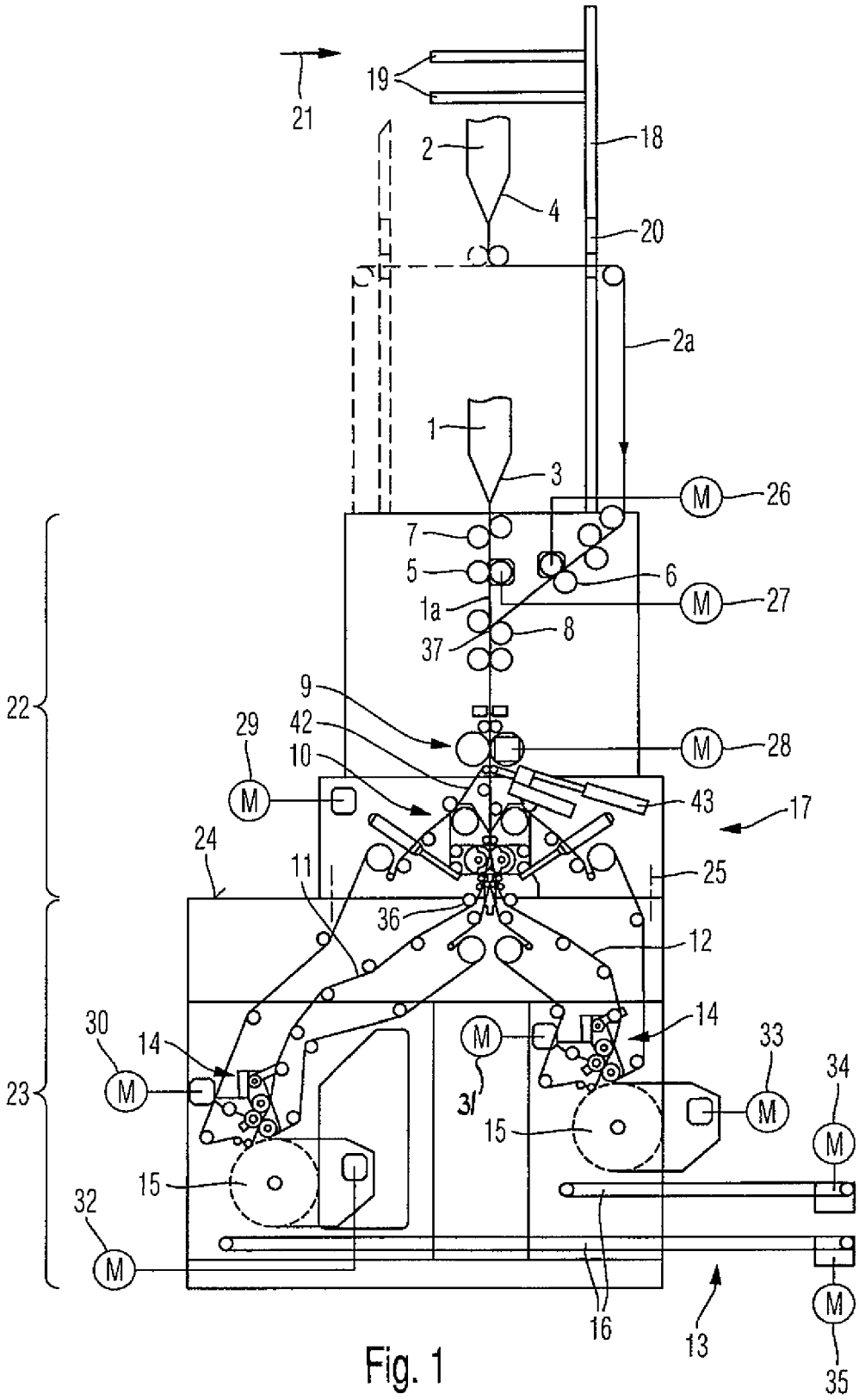
FIG. 1 is an overview of a folding apparatus with a device according to the invention.

The device shown in FIG. 1 serves to process web material, preferably in the form of printed paper substrate webs, to form longitudinally folded products in sheet form such as newspapers, etc. The web material 1, 2 in the form of individual webs or in the form of web packages comprising a plurality of webs placed one on top of the other is fed to the formers 3, 4 of a former arrangement and provided with a longitudinal fold in this way. Draw-in devices respectively 5, 6 arranged downstream of each former 3, 4 pull the respective web materials 1 and 2 over the associated formers 3 and 4. The draw-in devices 5, 6 preferably comprise two rollers which cooperate with one another. One of the rollers is driven, and guiding and deflecting rollers 7, 8 can be arranged in front of it and/or in back of the drawing device 4, 5.

The longitudinally folded material, designated hereinafter as webs 1*a* and 2*a*, respectively, is subsequently divided into products in sheet form by a cross cutting device 9. The resulting product flow is subsequently divided into two branch flows by a splitting device 10 and transported to a product delivery 13 by two belt guides 11, 12 following the splitting device. A braking device 14 is associated with each belt guide 11, 12 in the end region of the latter followed by a delivery fan 15. Delivery belts 16 on which the products are deposited in a layered flow are arranged below the delivery fans 15.

The above-mentioned units are arranged downstream of the draw-in devices 5, 6 in a machine frame 17 into which the webs 1*a*, 2*a* exiting from the formers 3, 4 run. The machine frame 17 has two side walls on which the above-mentioned devices are mounted. A superstructure wall 18 carrying the belt guiding members 19, such as the guide rods and/or turnover bars, etc, associated with the formers 3, 4 is mounted on the machine frame 17. These belt guiding members 19 are arranged in a cantilevered manner and are accordingly accessible from their end remote of the superstructure wall 18. The web 1*a* exiting from the lower former 3 preferably runs downward without being deflected. The web 2*a* which exits from the upper former 4 and which is designated in practice as a balloon web is preferably deflected to the side for passing around the lower former 1. For this purpose, the web 2*a* must be guided through the superstructure wall 18 which is provided with a through-window 20 for this purpose.

The superstructure wall 18 is arranged in such a way that the cantilevering guide members 19 are easily accessible from the side of the web feed indicated by arrow 21. The superstructure wall 18 is laterally offset relative to a center plane of the former arrangement. The direction of the web feed depends upon the arrangement of devices located upstream and can therefore change. When the web feed takes place from the side opposite to arrow 21, the superstructure wall 18 must be arranged on the other side of the former arrangement as is indicated by the dashed line in FIG. 1. Since the web 2*a* is guided through the superstructure wall 18 and is first guided under the associated draw-in device 6 in the same plane as the web 1*a* exiting from the former 3, the web guide associated with this web 2*a* extends symmetrically with respect to the arrangement indicated by the solid line with respect to the plane defined by the common transporting plane of the webs which are guided in a coplanar manner. It may also be the case that the delivery belts 16 deliver the products not to the right as in the embodiment example shown here but to the left-hand side.

To simplify variations of the type mentioned above, the machine frame 17 is formed of a plurality of modules which are arranged one on top of the other and which are rotatable by 180° relative to one another and can be fastened to one another in the respective end positions. Two modules are sufficient in practice. Consequently, two modules, namely, an upper module 22 and a lower module 23, are provided in the present example. The upper module 22 contains the draw-in devices 5, 6 with associated guiding and deflecting rollers 7, 8, the cross cutting device 9 and the splitting device 10. The lower module 23 contains the belt guides 11, 12 following the splitting device 10, and the braking devices 14, delivery fans 15 and delivery belts 16 associated with these belt guides 11, 12. In the area of the dividing line 24 between the modules 22 and 23 which extends at right angles to the vertical axis of rotation, these modules 22 and 23 which are rotatable relative to one another have mutual contacting surfaces and fastening means 25, indicated by their center lines, for anchoring with respect to one another in any desired final rotational position when placed on top of one another. These fastening means 25 are arranged symmetrically with respect to a vertical working plane of an adjacent unit, which working plane contains the axis of rotation.

In order that the products can be guided past the dividing line 24 in the same manner in any rotational end position, the units provided in the area of the dividing line 24 are formed symmetrically with respect to their vertical working plane containing the axis of rotation and consequently symmetrically with respect to their vertical center plane. The vertical working plane containing the axis of rotation corresponds to a vertical center plane, i.e., the transporting plane of the products when passing through the dividing line 24. In the present embodiment example, this symmetry applies to the output of the splitting device 10 and the input of the belt guides 11, 12 adjoining the latter.

To facilitate the rotatability of the modules 22 and 23, every module is preferably formed with independent driving means. For this purpose, every module has at least one drive motor associated with it. In the present example, a plurality of drive motors are provided on every module. For example, each draw-in device 5, 6 has its own drive motor 26, 27. The cross cutting device 9 has its own drive motor 28, and the splitting device 10 has its own drive motor 29. Accordingly, the upper module 22 contains four drive motors 26-29 which are independent from one another. The braking devices 14, delivery fans 15 and delivery belts 16 of the lower module are also assigned their own drive motors 30, 31 and 32, 33 and 34, 35, respectively. The lower module 22 accordingly contains six drive motors 30-35 which are preferably independent from one another. The mutual independence of the drive motors 26-35 facilitates the control and implementation of leading or lagging, which has an advantageous effect on accuracy and careful operation.

In the present example, the belt guides 11, 12 traverse the dividing line 24. Therefore, the belts of the belt guides 11, 12 are removed before one of the modules 22, 23 is rotated. However, the inner belt pulleys 36 of the belt guides 11, 12 provided in the area of the dividing line 24 are arranged symmetrically with respect to the working plane mentioned above so that the belt configuration is the same before and after the rotation of one of the modules 22, 23.

After combining, the webs 1*a*, 2*a* exiting from the formers 3, 4 can be transported further so as to lie one on top of the other or side by side depending on the former arrangement. To keep every possibility open and to ensure high flexibility, all members and devices are formed in two tracks downstream of the combining point 37, i.e., in such a way that two webs can run side by side if required. The side walls of the frame of the modules 22, 23 are far enough apart to give the required working width. The devices according to FIGS. 2-8 are based on the two-track construction mentioned above.

Figure 2:
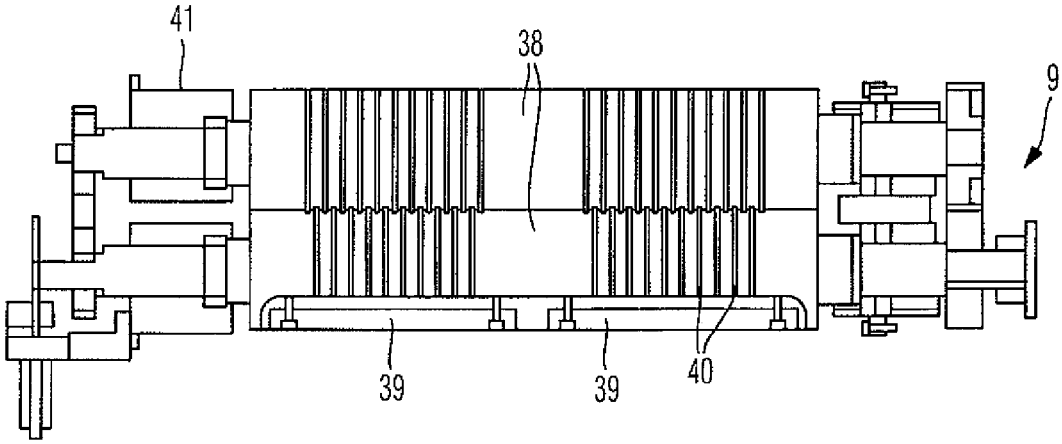
FIG. 2 is a cross cutting device according to FIG. 1 in partial section.

The cutting device 9 shown in FIG. 2 comprises two parallel cutting cylinders which are adjusted toward one another along the circumference and which each have two adjacently arranged knives 39, each of which is associated with a track. In the region of their longitudinal portions respectively associated with a track, the cutting cylinders 38 are provided with circumferential grooves interrupted by the knives 39. Strips made of a compressible material, preferably Vulkollan®, which project radially relative to the respective adjacent intermediate areas are pressed into the grooves 40 and produce a mini-beading of continuous material. In this way, the start of the web which is produced anew after every cut does not fan out even when the products comprise multiple layers.

The length of the products depends on the diameter of the cutting cylinders 38. In case of a change in length, the cutting cylinders 38 must be exchanged. In order to facilitate this, the cutting cylinders 38 are mounted in lateral eccentric bearings 41. Therefore, the axial distance can be changed by rotating the eccentric bearings 41.

As can be seen from FIG. 1, the products produced by the action of the cross cutting device 9 run into a lead-in mouth of a belt guide portion 42 and are transferred from there to the splitting device 10. Backups can easily occur in the region of the above-mentioned lead-in mouth of the belt guide portion 42. In order to take countermeasures swiftly, one side of the belt guide portion 42 can be swiveled away from the opposite side. A swiveling cylinder 43 is provided for this purpose.

Figure 3:
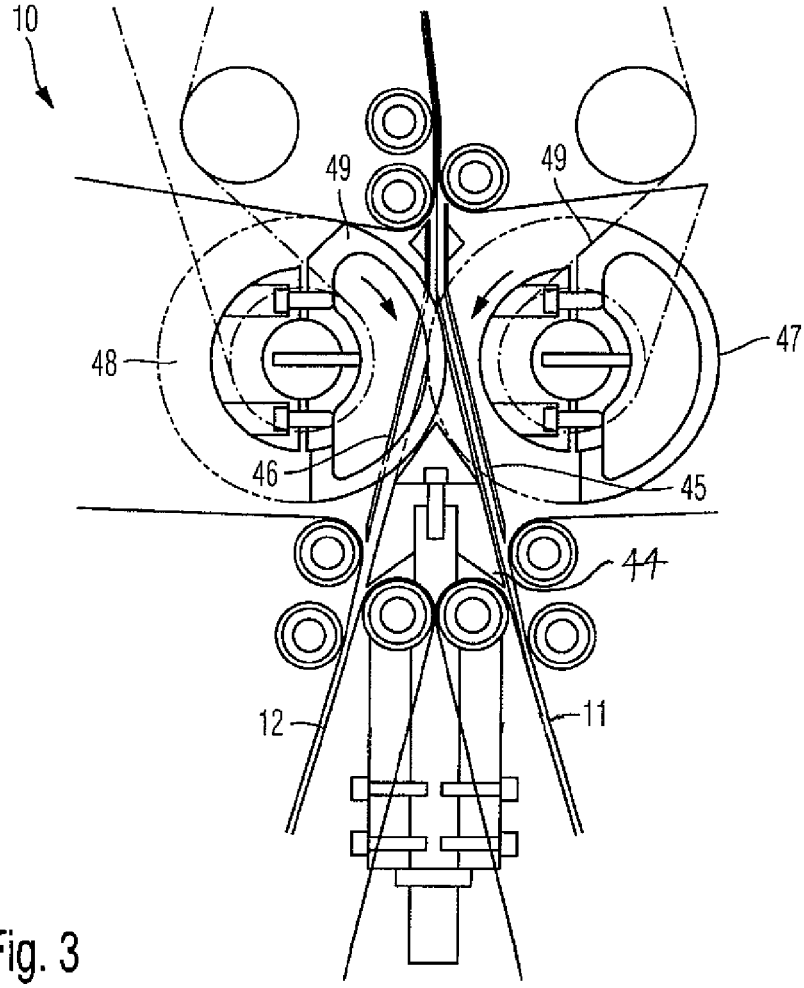
FIG. 3 is an enlarged view of the splitting device from FIG. 1.

As can be seen most clearly from FIG. 3, the splitting device 10 contains a wedge 44 which is formed and arranged symmetrically with respect to its vertical working plane and which engages between two guide plates 45, 46 which flank it. Together with the wedge 44, these guide plates 45, 46 define a path fork which is symmetric to the above-mentioned working plane and opens downward. Two cam rollers 47, 48 which flank the guide plates 45, 46 and which are arranged symmetrically with respect to the above-mentioned working plane are associated with the guide plates 45, 46. The cam rollers 47, 48 are provided along their length with two sets of radially projecting cams 49, each set being associated with a track. The cams 49 of the cam rollers 47, 48 alternately project through the respective adjacent guide plate 45, 46 and, together with the other respective guide plate, form a feed for a belt guide 11, 12 associated with a branch flow.

Figure 4:
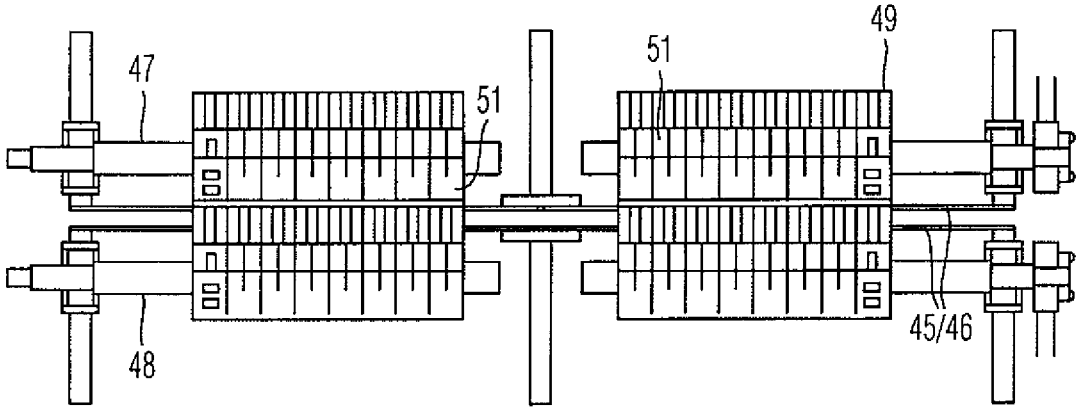
FIG. 4 is a top view of the cam rollers according to FIG. 3.
Figure 5:
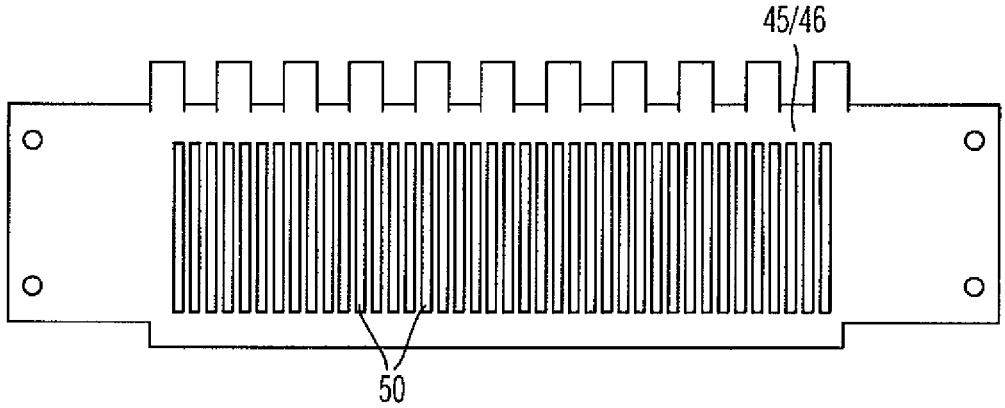
FIG. 5 is a top view of a guide plate from FIG. 2.

As can be seen most clearly from FIG. 4, the cam rollers 47, 48 are provided with many narrow, disk-shaped cams in two longitudinal areas associated with the above-mentioned tracks, narrow gaps being provided between these cams. As can be seen from FIG. 5, the guide plates 45, 46 are provided with narrow slots 50 which are associated with the narrow, disk-shaped cams 49 and in which the cams 49 can engage so as to mesh. In an advantageous manner, the wedge 44 is vertically adjustable. As can be seen from the movement arrows in FIG. 3, the cam rollers 47, 48 are driven in opposite directions and arranged in such a way that their cams 49 face in the same direction. This ensures that the cams 49 of the cam rollers 47, 48 alternately project through the slots 50 of the respective adjacent guide plate 45, 46.

As is shown in FIG. 4, the cam rollers 47, 48 have a continuous roller on which elements 51 are clamped, each of which contains a plurality of cams 49. These above-mentioned shafts are mounted in the area of their ends on the side walls of the associated module frame of the upper module 22. In the present example, this module 22 is provided with an intermediate wall on which the above-mentioned shafts can also be supported, which ensures a high stability and quiet running in spite of the large length and large imbalance caused by the elements 51.

Figure 6:
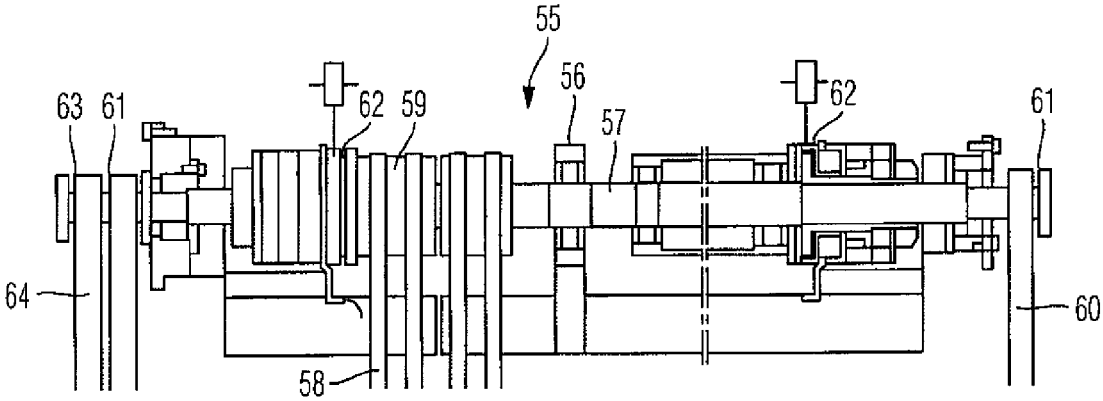
FIG. 6 is a partial section showing a belt roller of a belt guide, which belt roller is driven on two tracks.

FIG. 6 shows a driven belt roller 55 of the belt guides 11, 12. The belt roller 55 also has a shaft 57 which is continuous over the entire width, is mounted by its ends on the side walls I and II, and is supported in the middle on an intermediate wall 56. This shaft 57 is provided in the area of each track, i.e., in the area between the intermediate wall 56 and a respective side wall I or II, with belt pulleys associated with the belts 58 of the associated belt guide or, as in the example, with belt drums 59 around which a plurality of belts 58 are looped. The belt roller 55 is driven by a driving belt 60 which is driven derivatively by a drive motor of an adjacent processing unit, advisably by the drive motor 28 associated with the cross cutting device 9. With respect to the mutual rotatability of the two modules 22, 23, the shaft 57 is provided in the area of both ends with belt disks 61 which are arranged symmetrically with respect to the center plane, and a driving belt 60 leading to the cross cutting device 9 can be associated with these belt disks 60. Insofar as only one such driving belt is provided, this driving belt is placed on the belt disk 61 located on the correct side. The other remains empty.

In every case, the shaft 57 rotates over its entire length. However, the belts 58 associated with the two tracks can be activated or deactivated per track. For this purpose, the associated belt pulleys or belt drums 59 can be selectively coupled to the shaft 57 by means of a coupling 62. The drive can be transmitted to other driven belt rollers by the shaft 57 of the first belt roller 55, which shaft 57 has a drive-connection to the cross cutting device 9. For this purpose, a second belt disk 63, from which a driving belt 64 leads to a corresponding belt disk of another belt roller, is provided on one end of the shaft 57.

Figure 7:
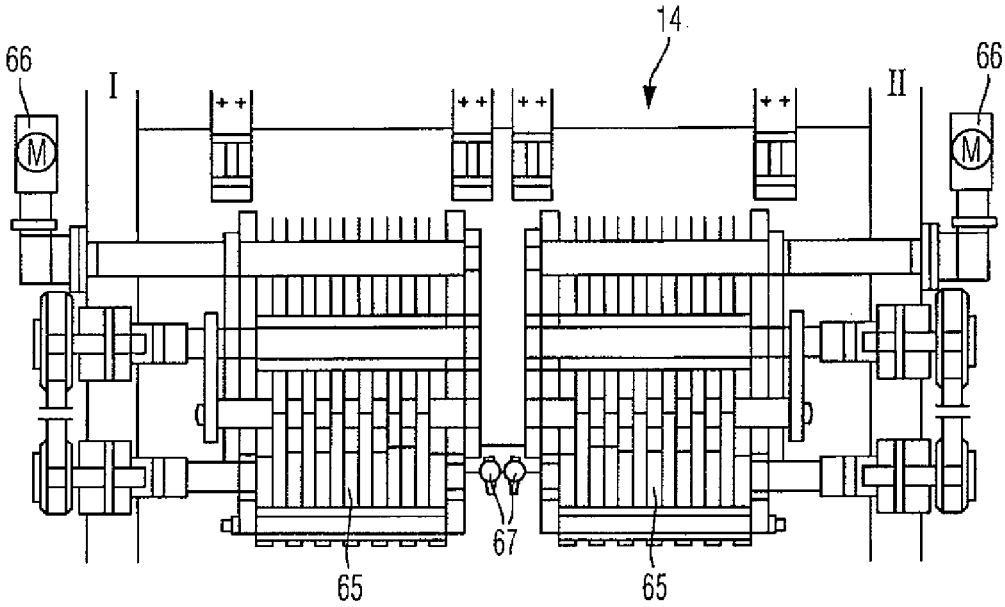
FIG. 7 is a top view in partial section showing a two-track braking device from FIG. 1.

As can be seen from FIG. 7, the braking devices 14 associated with the ends of the belt guides 11, 12 have two sets of braking cams 65 arranged side by side at a distance from one another along the width of the machine. These braking cam sets 65 can be adjusted independently from one another relative to an associated complementing member by means of an associated actuating motor 66. Sensors 67 which monitor the braking action can be associated with the actuating motors 66. In this way, the braking gap can be adjusted individually.

Figure 8:
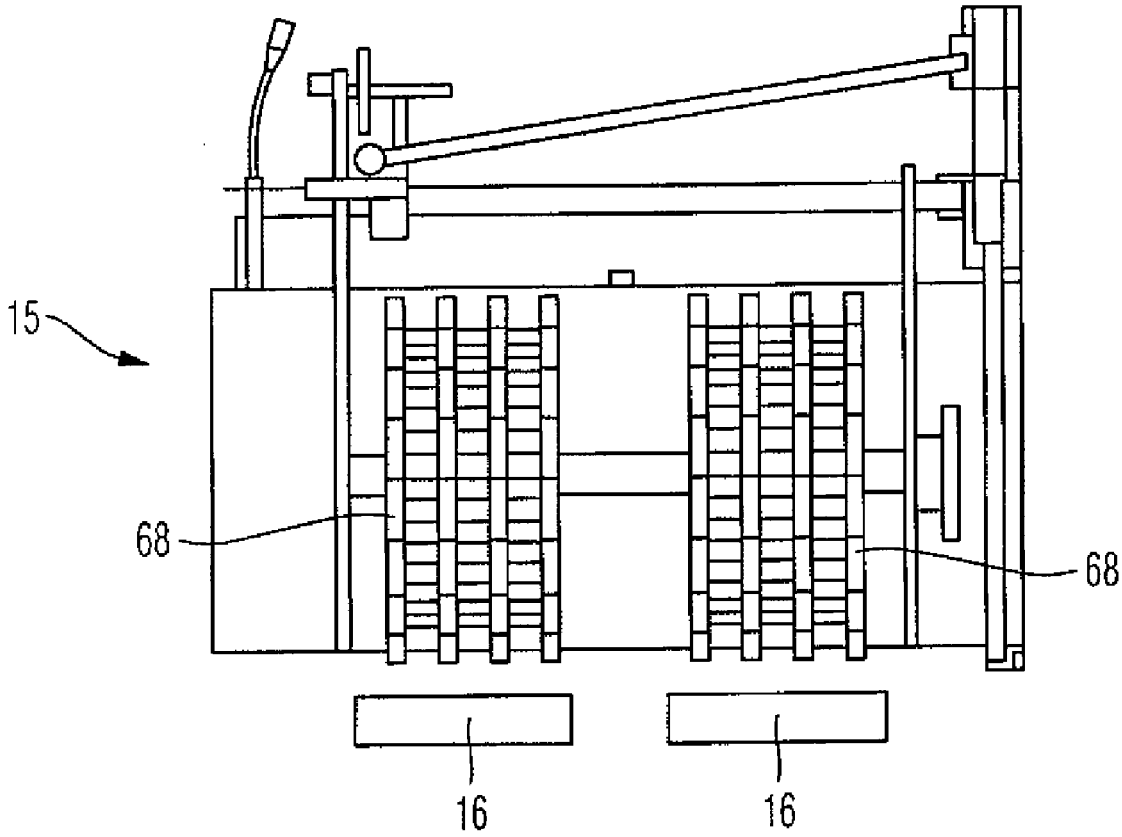
FIG. 8 is a top view showing a two-track delivery fan from FIG. 1.

As can be seen from FIG. 8, the delivery fans 15 provided above the delivery belts 16 contact blade sets 68 which are arranged side by side at a distance from one another along the width of the machine. Each set of blades 68 can have its own delivery belt 16. Every two delivery belts 16, only one of which is visible in FIG. 1, are arranged adjacent to one another as a result of the two-track design.

According to the example described above, the machine frame 17 contains only the upper module 22 and the lower module 23, that is, only two modules. However, it would also be possible to provide a plurality of modules. For this purpose, for example, the upper module 22 of the arrangement shown in FIG. 1 could be divided into a plurality of partial modules, for example, a first partial module containing the cross cutting device 9 and a second partial module containing the splitting device 10. The dividing line would then advisably lie directly below the cross cutting device 10.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A device for distributing successive folding products produced by a cross cutting device by dividing a material web into two branch flows comprising:

a wedge arrangement arranged in a transporting plane of a product flow;

two cam rollers arranged symmetrically with respect to a center working plane that flank the wedge arrangement, each of the cam rollers having an associated plurality of cams;

two guide plates that flank the wedge arrangement configured to define a path fork with the wedge arrangement, each of the guide plates having a plurality of slots; and a pair of rollers associated with a pair of belt guides configured to laterally deflect the folded product upstream of the guide plates;

wherein the guide plates are alternately penetrated by the plural cams of the respective adjacent cam rollers associated with the plural slots during rotation of the two cam rollers, wherein the penetrating cams and the one of the guide plates that is not penetrated form a feed for a belt guide associated with one of the branch flows.

2. The device according to claim 1, wherein the two cam rollers have the plural cams arranged along their respective lengths in a closely spaced manner next to one another, and the guide plates have a plurality of slots corresponding with the plural cams.

3. The device according to claim 1, wherein the wedge arrangement is vertically adjustable.

4. The device according to claim 2, wherein the cam rollers are driven in opposite directions and are arranged in such a way that the plural cams of the two cam rollers face in the same direction.

5. The device according to claim 2, wherein the plural cams of the two cam rollers extend over a circumferential segment of identical dimensions.

6. The device according to claim 1, wherein the two cam rollers have continuous shafts on which are clamped a plurality of cam carriers each provided with the plural cams.

7. The device according to claim 1, wherein each belt guide is associated with a branch flow having an outer transporting belt, configured for lateral guiding in an area downstream of the cam rollers and which is deflected in direction of the belt guide, and an inner transporting belt which is deflected downstream of and behind the wedge.

8. The device according to claim 1, wherein the wedge arrangement comprises a plurality of wedges which are continuous at least over a width of the cam rollers a that is provided with a plurality of cams.

* * * * *